US005496042A

United States Patent [19]

Craft et al.

[11] Patent Number: 5,496,042

[45] Date of Patent: Mar. 5, 1996

[54] TWISTING ARROWHEAD

[76] Inventors: William C. Craft; Ruth L. Craft, both of R.F.D. #5 Box 5510, Skowhegan, Me. 04976

[21] Appl. No.: 414,211

[22] Filed: Mar. 31, 1995

[51] Int. Cl.[6] ..... F42B 6/08

[52] U.S. Cl. ..... 273/421

[58] Field of Search ..... 273/416, 419, 273/420–422

[56] References Cited

U.S. PATENT DOCUMENTS

| | | | |
|---|---|---|---|
| 3,527,463 | 9/1970 | Turner | 273/420 |
| 3,976,298 | 3/1976 | Hinchman | 273/420 |
| 4,489,949 | 12/1984 | Taylor et al. | 273/416 X |
| 4,596,393 | 6/1986 | Orav | 273/420 |
| 4,842,285 | 6/1989 | Farler | 273/420 |
| 4,900,038 | 2/1990 | Czetto et al. | 273/416 |

FOREIGN PATENT DOCUMENTS

| | | | |
|---|---|---|---|
| 2029711 | 3/1980 | United Kingdom | 273/416 |

*Primary Examiner*—Paul E. Shapiro
*Attorney, Agent, or Firm*—David F. Gould

[57] ABSTRACT

An arrow having a longitudual hollow shank portion containing a sliding element which moves forward upon the impact of the arrow with a target and twists a receiving element connected to a rotatably mounted arrowhead to rapidly rotate the arrowhead and thus give the arrowhead great stopping power when hunting game.

5 Claims, 1 Drawing Sheet

TWISTING ARROWHEAD

BACKGROUND OF THE INVENTION

1. Field of the Invention

The present invention relates generally to arrowheads for hunting arrows and more particularly, to an arrowhead which rapidly rotates upon impact with a target.

2. Description of the Prior Art

Bow and arrow hunters desire to humanely kill game such as deer with a single shot that will drop the targeted animal It's not the intent of the arrow hunters to cause an injury that will cause the game to slowly bleed to death from a non-lethal puncture wound.

There are a variety of game hunting arrows on the market at the present time. One approach to making arrows more lethal is to devise arrowheads that expand upon inpact with the game animal to prevent the arrow from completely passing through the animal's body. One of the disadvantages of expanding arrowheads is their increased weight. Another disadvantage of expanding arrowheads is their increased cost because of their mechanical complexity.

Another approach to increasing arrow killing power has been to make the arrowheads extra large. The disadvantages of large arrowheads are that they unbalance the arrow and slow the arrow down in flight because of their increased size. Extra large arrowheads are also affected by crosswinds and other wind currents while in flight and thus suffer loss of accuracy.

It is also well known to configure the arrow so that it twists in flight like a rifle bullet. However, it is not possible to get enough arrow rotation by aerodymatic forces alone to give the arrowhead significant killing power.

SUMMARY OF THE INVENTION

It is a general object of the present invention to provide an arrowhead for hunting arrows which rapidly rotates upon impact with a target to give the arrowhead greater stopping power.

Another object of the invention is to provide an arrow of slim cross-section in which the moving parts are aerodymamicly housed inside a hollow compartment or portion of the shank of the arrow.

It is yet another object of the present invention to provide an arrowhead that will transfer most of the kinetic energy of the arrow in flight into the target upon impact. The aforestated and additonal objects and advantages will be appreciated by those of ordinary skill in the art by reference to the present invention as described in the summary, the drawings, detailed description and claims which follow.

My improved arrow has a hollow shank portion that holds the operating parts of the invention as will be detailed hereinafter in reference to the operation of my invention. The tail of my arrow is conventional The arrowhead of my invention is mounted rotatably upon the arrow shank. A sliding element is disposed inside of the hollow of the arrow shank. An impact receiving element is attached to the arrowhead to cooperate with the sliding element as will be detailed later in reference to the operation of my invention.

The foregoing co-operating parts enable the arrowhead to rapidly twist as it impacts the target thus giving a clean kill of the game by causing greater damage to the game than would be the case with a rigidly mounted arrowhead.

DESCRIPTION OF PREFERRED EMBODIMENT

Figure 1:
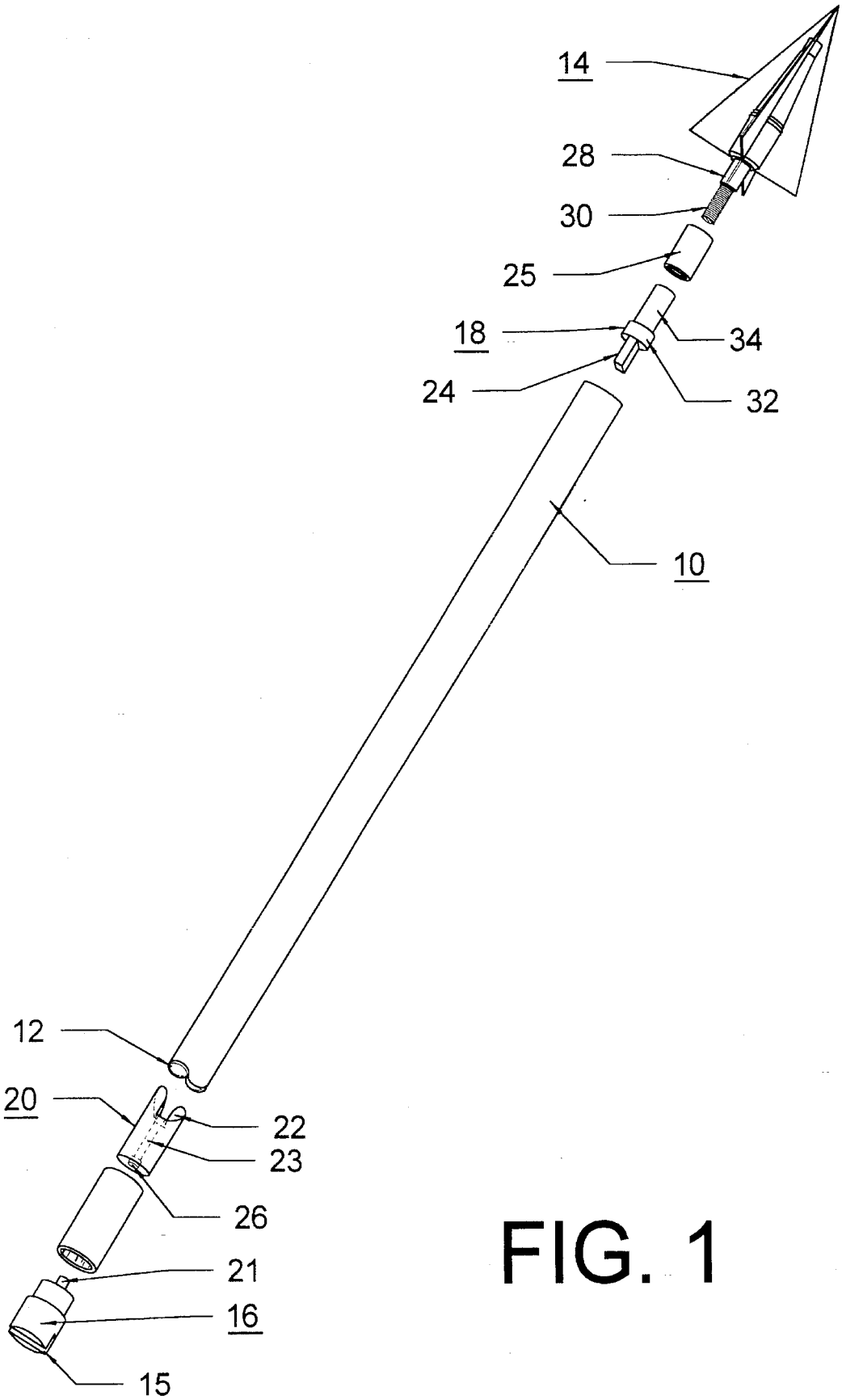
FIG. 1 is an exploded view, partly in section of the arrow of the invention showing the moving parts of the invention in their position before the arrow impacts a target.

Referring to FIG. 1, we provide an arrow 10. In the forward part of the arrow 10, We provide a longitudinal hollow shank portion 12. An inertia dense is provided in the form of a sliding element 20 which is slidably mounted in the hollow shank portion 12. The sliding element 20 is provide with an axial vent aperture 23 as well as a specially shaped curved driving surface 22 on the left hand or leading portion of the sliding member 20. The sliding member 20 also has an end groove 26 shaped to mate with an insert 21 in a tail position 16 Of the arrow 10 as will be described hereinafter in relation to the operation of our invention. On the forward end of the arrow 10 is a rotatably mounted arrowhead 14. The arrowhead 14 is provided with a cylindrical rearward extension 28 and a threaded portion 30. An impact receiver or receiving element 18 is provided on its forward right hand end with a female thread (not shown) to receive the the threaded portion 30 of the arrow head 14. The rear end of the impact receiving or receiver element 18 has a rectangular extended portion 24 which co-acts with curved driving surface 22 on the forward end of the sliding element 20 when the arrow 10 impacts a target (not shown). The curved driving surface 22 on the forward end of the sliding element 20 is cam-shaped to engage and twist the impact receiving element 18 and thus rotate the attached arrowhead 14.

The receiving element 18 has an internal female thread (not shown) to receive the threaded portion 30 of the arrow head 14. The receiving element 18 is provided with a reduced diameter cylindrical forward portion 34 which has an outer diameter sized to loosely fit in the inner diameter of a bushing 25. The inner diameter of the bushing 25 also sized to loosely fit a cylindrical extended portion 28 of the arrowhead 14. The receiving element 18 is also provided with a shoulder portion 32 that acts as a stop for the bushing 25. The outer diameter of the shoulder portion 32 of the receiving element 18 is also sized to slidably fit in the hollow shaft 12 of the arrow 10.

A groove 26 in the rear end of the sliding element 20 is designed to fit an insert 21 the tail end 16 of the arrow 10 when the sliding element 20 is in its initial rest position at the tail end of the hollow shaft 12. This rest position of the sliding element 20 insures maximum travel of the sliding element 20 towards the front of the arrow 10 when the arrow 10 hits a target. Alternatively, the sliding element 20 may be temporarily kept in its resting position by means of an "O" ring (not shown) on the rear end of the sliding element 20.

Additional twisting action can be imparted to the sliding element 20 by adding spiral "lands" (not shown) to the exterior of the sliding element 20 similar to the "lands" used on the exterior of solid slug shotgun ammunition.

The arrow 10 of our invention is provided with a tall 16 that has groove 15 to receive a conventional bow string (not shown). Although tail feathers are not illustrated as part of the invention, they are of course used to complete the arrow

OPERATION

In operation, the sliding element 20 would be located before flight in the hollow shaft portion 12 of the arrow 10 near the arrow tail 16 and remote from the receiving element or impact receiver 18. When the arrowhead 14 impacts its target, the sliding element 20 is driven rapidly forward in the hollow shaft 12 by its inertia. The curved driving surface 22 of the sliding element 20 contacts the extended portion 24 of the receiving element or impact receiver 18 which is threaded into the rotatably mounted arrowhead 14. The function of the axial vent aperture 23 in the sliding element 20 is to allow air to pass through the sliding element 20 and thus prevents the sliding element 20 from acting like a piston and compressing air in the hollow shank portion 12 of the arrow 10. Any compressing of air would slow the travel of sliding element 20 along the hollow shaft 12 toward the receiving element 18.

Thus, the axial aperture 23 permits the sliding element 20 to move forward at maximum speed towards the extended portion 24 of the receiving element or impact receiver 18. The kinetic energy of the rapidly moving sliding element 20 is transferred by its cam curved driving surface 22 to the impact receiver or receiving element 18 causing the receiving element or impact receiver 18 to twist and rapidly rotate the attached rotatably mounted arrowhead 14. This rapid twisting motion of the arrowhead 14 prevents the arrowhead 14 from going straight through a target without doing significant damage to the target such as a deer or other large game animal.

While there has been described herein a particular embodiment of the invention, it will be obvious to those skilled in the art that various changes and modifications may be made therein without departing from the invention. Therefore, it is aimed to cover all such changes as fall within the true spirit and scope of this invention.

We claim as our invention:

1. In an arrow the improvement comprising:

a. a longitudinal hollow shaft compartment, b. a sliding element disposed in the hollow shaft compartment, c. a rotatably mounted arrowhead located near the forward end of the hollow shaft compartment, d. a receiving element connected to the arrowhead to cause the arrowhead to twist when struck with the sliding element upon the impact of the arrow with a target.

2. The arrow of claim 1 in which the sliding element has a forward end curved driving surface shaped to engage and twist the receiving element upon the impact of the arrow with a target.

3. The arrow of claim 2 in which the receiving element has an extended portion to engage the forward end curved driving surfaces of the sliding element upon the impact of the arrow with a target.

4. The arrow of claim 1 in which the sliding element is provided with at least one axial vent aperture to prevent compressing air in the hollow shaft compartment upon movement of the sliding element caused by the impact of the arrow with a target.

5. The arrow of claim 1 in which means are provided to retain the sliding element at the end of the hollow shaft compartment remote from the receiving element until impact of the arrow with a target.

* * * * *